US007197848B2

(12) United States Patent
Vaccari et al.

(10) Patent No.: US 7,197,848 B2
(45) Date of Patent: Apr. 3, 2007

(54) SWING FLAP FOR THE ENTRY AND EXIT OF PETS

(75) Inventors: Carlo Vaccari, Castelgomberto (IT); Alfred Pellegrini, Montebelluna (IT)

(73) Assignee: Ferplast S.p.A. (IT)

( * ) Notice: Subject to any disclaimer, the term of this patent is extended or adjusted under 35 U.S.C. 154(b) by 392 days.

(21) Appl. No.: 10/498,601

(22) PCT Filed: Dec. 12, 2002

(86) PCT No.: PCT/IT02/00787

§ 371 (c)(1),
(2), (4) Date: Jun. 9, 2004

(87) PCT Pub. No.: WO03/052231

PCT Pub. Date: Jun. 26, 2003

(65) Prior Publication Data

US 2005/0066578 A1 Mar. 31, 2005

(30) Foreign Application Priority Data

Dec. 14, 2001 (IT) ..... VR2001U0068

(51) Int. Cl.
*E05D 15/48* (2006.01)

(52) U.S. Cl. ..... 49/169; 160/180

(58) Field of Classification Search ..... 49/169, 49/163, 168; 160/180, 2, 116, 181; 52/455, 52/458

See application file for complete search history.

(56) References Cited

U.S. PATENT DOCUMENTS 5,406,748 A 4/1995 Davlantes ..... 49/169
D445,915 S * 7/2001 Kirk ..... D25/48
6,385,909 B1 * 5/2002 Marsh et al. ..... 49/169

FOREIGN PATENT DOCUMENTS

| | | | |
|---|---|---|---|
| GB | 2 101 182 A | | 1/1983 |
| GB | 2142070 A | * | 1/1985 |
| GB | 2 236 135 | | 3/1991 |
| WO | WO 99 67492 A | | 12/1999 |

OTHER PUBLICATIONS

International Search Report of Mar. 28, 2003.

* cited by examiner

*Primary Examiner*—Hugh B. Thompson, II
(74) *Attorney, Agent, or Firm*—Greenberg Traurig, LLP; Charles Berman, Esq.; R. Joseph Foster, Esq.

(57) ABSTRACT

A swing flap (10) for the entry and exit of pets comprising a frame (11), which can be fixed to an opening (12) made in a door or a wall, equipped at the top with hinged means of constraint for a flap (20), and a first function selector (30), designed to control the opening and closing functions of the swing flap (10), this selector comprising a knob (29) integral with a first pair of elements (31, 32) being shaped in such a way to allow, respectively: the opening of the flap (20) in a first direction;

the opening of the flap (20) in a second direction, opposite to the first direction;

the opening of the flap (20) in both directions;

blocking of the opening of the flap (20).

The first selector (30) is kinematically connected to a second selector (36), not equipped with a knob but with a second pair of elements (31', 32') which control the opening and closing of the flap (20) depending on how the knob (29) is turned.

4 Claims, 2 Drawing Sheets

SWING FLAP FOR THE ENTRY AND EXIT OF PETS

TECHNICAL FIELD

This invention concerns a swing flap for the entry and exit of pets.

More specifically, the invention refers to a swing flap for the entry and exit of medium-large size pets, with a structure that allows it to be fitted to the doors or walls of houses.

This invention can be applied in the industry for the production of articles for pets.

BACKGROUND ART

The use of swing flaps fitted to doors to allow the independent exit and entry of pets without having to continually open and close the door, also to prevent any damage to the door as a result of scratching and knocks made by the animals, is a known fact.

An opening is generally made in the door, close to the ground, bordered by a support frame equipped at the top with pins designed to act as hinges for the flap to swing open as a result of the pressure exercised by the animal and close by means of gravity.

It is currently possible to use flaps connected to servomechanisms, for example a linear actuator, which can be controlled by special electronic units that can receive a signal from a transmitter on the collar of the animal wishing to pass through the flap, thus preventing undesired entries and exits.

Current background art also includes solutions that foresee the use of electromagnetic devices consisting of a reed switch and a diode on a circuit which is closed by the entry or exit of the pet wearing a collar fitted with a magnet.

According to other known embodiments, a transponder interacts with an electronic control unit which, by means of actuators, regulates the possibility of opening or closing the flap.

In these cases too, therefore, closure of the circuit enables the movement of one or more actuators which open or close the flap.

According to the background art, the swing flap is equipped with a function selector which ensures a number of possibilities and in particular the opening can be permitted:

for entry into the house only, for exit from the house only, for both entry and exit, for neither entry nor exit.

This selector usually consists of a knob which is integral with variously shaped elements designed to block the flap directly.

One disadvantage is represented by the fact that, especially if the flap is meant to be used by large animals, only one knob fitted with a blocking device is not sufficient to resist strong pushes in the long term.

Solutions that foresee several knobs with respective blocking devices at the sides of the flap would tend to complicate the selection by the user.

DESCRIPTION OF THE INVENTION

This invention aims to provide a swing flap that can eliminate or significantly reduce the drawbacks described above.

This invention also proposes to provide a swing flap which is easy to manufacture and can be produced at a low cost, thus being economically advantageous.

Another aim of this invention is to provide a swing flap which is universally applicable to any door or wall.

This is achieved by means of a swing flap for pets with the features described in the main claim.

The dependent claims described advantageous embodiments of the invention.

The swing flap for pets according to this invention comprises a frame, which can be fixed to an opening made in a door or a wall, equipped at the top with hinged means of constraint for a flap, and a first function selector, equipped with blocking elements and designed to control the opening of the flap, kinematically connected to a second selector equipped with identical blocking elements.

According to this invention, the first selector consists of a knob, easily accessible to the user, integral with the said variously shaped blocking elements which control the opening and closing operations of the flap.

These selectors are preferably housed in the frame close to the free portion of the flap.

The kinematic connection between the selectors can be achieved by means of a toothed belt engaging with the toothed wheels integral respectively with the selector and the blocking device or devices.

Alternatively, this kinematic connection can be achieved by means of a train of gears or by articulated systems controlled by the selector.

The first selector can be motor-driven, receiving energy from any appropriate source and presenting an external pushbutton to enable it.

DESCRIPTION OF THE DRAWINGS

Other features and advantages of the invention will become apparent from the following description of an embodiment of the invention, provided purely as a non-restricting example, with reference to the accompanying drawings, in which.

DESCRIPTION OF A FORM OF EMBODIMENT

In the figures, the reference number 10 indicates in general a swing flap, in the case in question a swing flap 10 for medium-large size pets.

The flap 10 comprises a frame 11 positioned and fixed inside a respective opening made in a door or a wall of a house which separates an internal space from an external space.

The frame can consist of an internal half shell and an external half shell, cooperating reciprocally and with at least one fixed to the door or wall, presenting the respective passageways.

The upper portion of the passageway of the internal half shell presents hinged means of constraint for a flap 20 designed to close the passageway.

The hinged means of constraint can consist of housings designed, in action, to accommodate respective pins integral with the upper part of the flap 20.

In this way the flap 20 is free to swing from a closed position of the passageway to an open position to allow pets to pass through.

Figure 1:
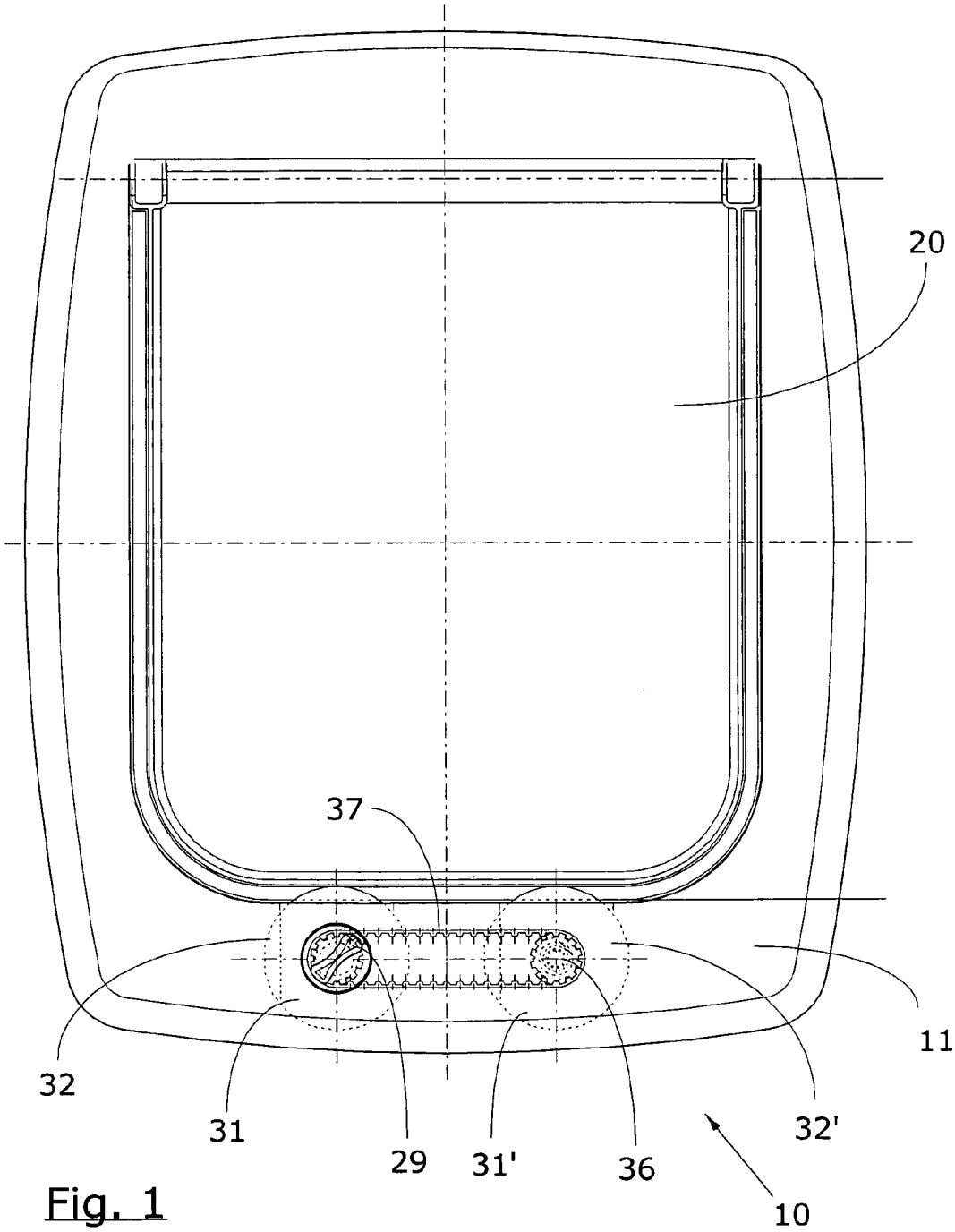
FIG. 1 shows a front elevation of a flap according to the invention.
Figure 2:
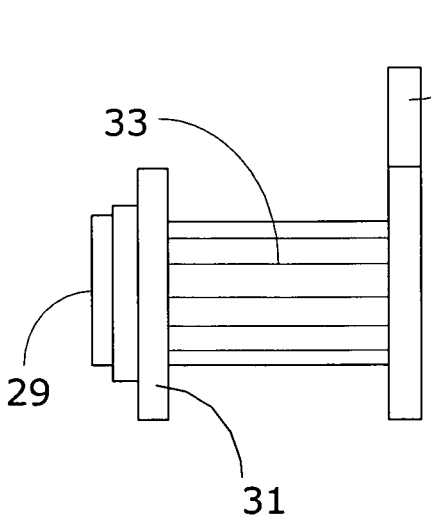
FIG. 2 shows an enlarged schematic side elevation of a first selector equipped with a knob.
Figure 3:
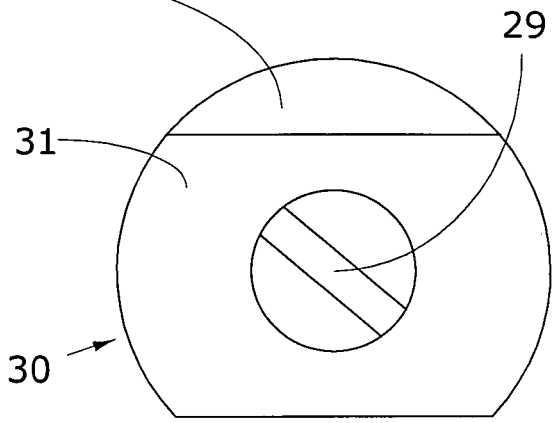
FIG. 3 is a front view of FIG. 2.

The internal half shell presents a first selector 30 equipped with a knob 29 which is hinged to it and easily accessible to the user from inside the house. The first selector 30, housed in a respective cavity of the lower portion of the frame, is fitted with a pair of variously shaped elements 31, 32 (FIGS. 2 and 3) designed to act as blocking devices.

The first selector 30 is also equipped with a toothed cylinder 33 positioned between the two eccentric elements 31, 32.

By turning the knob 29 the elements 31, 32 can be positioned in such a way to allow or prevent the opening of the flap 20.

The operation of the first selector 30 by means of the knob 29 is thus able to ensure a number of possibilities of use of the swing flap 10 and in particular the opening of the flap 20 can be allowed:

for entry into the house only, for exit from the house only, for both entry and exit, for neither entry nor exit.

Figure 4:
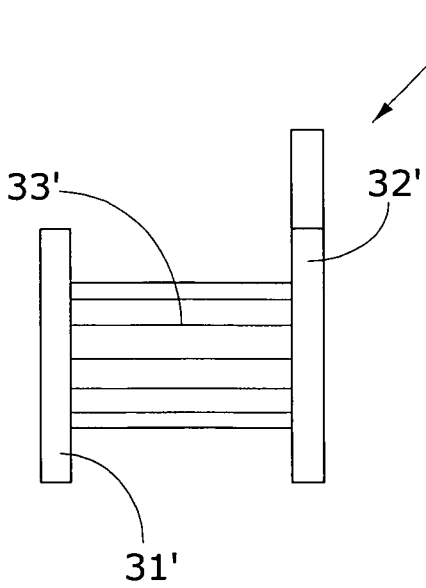
FIG. 4 shows an enlarged schematic side elevation of a second selector equipped with a knob.
Figure 5:
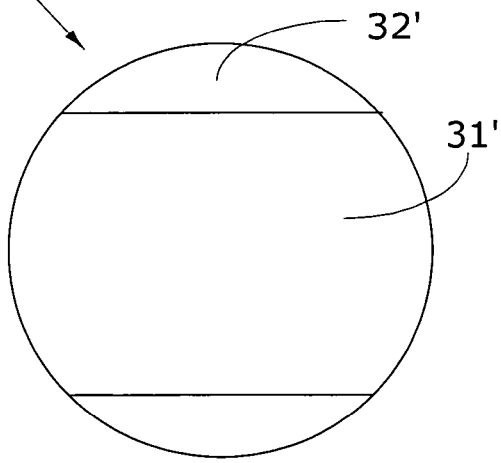
FIG. 5 shows a front view of FIG. 4.

The lower portion of the frame 11, inside the inner half shell, presents a chamber designed to connect the cavity containing the knob 29 with a second cavity designed to contain a second selector 36 (FIGS. 4 and 5).

The second selector 36 is similar to the first selector, in turn presenting variously shaped elements 31', 32' connected by means of a toothed cylinder 33' integral with them.

According to this invention, the two selectors are kinematically connected by means of a toothed belt 37 concealed inside the chamber 34.

Turning the knob 29 of the first selector 30 causes an immediate and corresponding rotation of the second selector 36. In the closed position, with the eccentric elements 31, 32, 31', 32' projecting inside the compartment, this offers greater and uniform resistance to the pressure which may be exercised by an animal against the flap 20 even if the pressure is on only one side of the flap.

According to another form of embodiment of the invention, there can also be several selectors, reciprocally connected and distributed around the compartment.

According to a variation not shown in the drawings, the kinematic connection between the selectors can be achieved by means of a gear train or by articulated systems controlled by the first selector.

Additionally, the first selector can be power-driven, receiving energy from any appropriate source and presenting an external pushbutton to enable it.

The invention is described above with reference to a preferred embodiment. It is nevertheless clear that the invention is susceptible to numerous variations within the framework of technical equivalents.

The invention claimed is:

1. A swing flap for the entry and exit of pets comprising a frame, which can be fixed to an opening made in a door or a wall, equipped at the top hinges of constraint for the flap, and a first function selector, designed to control the opening and closing functions of the swing flap, this selector comprising a knob integral with a first pair of elements acting on both sides of the flap being shaped in such a way to allow, respectively:

the opening of the flap in a first direction;

the opening of the flap in a second direction, opposite to the first direction;

the opening of the flap in both directions;

blocking of the opening of the flap, wherein the first selector is kinematically connected to a second selector, not equipped with a knob but with a second pair of elements acting on both sides of the flap, whereby the rotation of said knob induces a simultaneous and coordinated rotation of both selectors.

2. The swing flap according to claim 1, wherein the kinematic connection between the first selector and the second selector is achieved by means of a toothed belt engaging with toothed wheels integral respectively with the first selector and the second selector.

3. The swing flap according to claim 1, wherein the kinematic connection and the second selector are concealed inside the frame.

4. The swing flap according to claim 1, wherein the first selector is power-driven, receiving energy from any appropriate source and presenting an external pushbutton to enable movement thereof of the first selector.

* * * * *